US005908376A

United States Patent [19]

Macaluso et al.

[11] Patent Number: 5,908,376

[45] Date of Patent: Jun. 1, 1999

[54] SELF-CLEANING ROTOR FOR A CENTRIFUGAL SEPARATOR

[75] Inventors: Lawrence L. Macaluso; David H. Meikrantz, both of Carson City, Nev.

[73] Assignee: Costner Industries Nevada, Inc., Carson City, Nev.

[21] Appl. No.: 08/927,737

[22] Filed: Sep. 11, 1997

[51] Int. Cl.[6] ..... B04B 1/04; B04B 15/06

[52] U.S. Cl. ..... 494/29; 494/74

[58] Field of Search ..... 494/23, 27, 29, 494/30, 37, 64, 74, 79; 366/169.1, 169.2, 170.2, 170.4; 210/209–211, 213

[56] References Cited

U.S. PATENT DOCUMENTS

| | | | |
|---|---|---|---|
| 581,354 | 4/1897 | Lapp | 494/27 |
| 1,886,111 | 11/1932 | Lorentsen | 494/27 |
| 2,184,598 | 12/1939 | Jahn | 494/27 |
| 2,528,974 | 11/1950 | Ritsch | 494/30 |
| 2,563,550 | 8/1951 | Quist | 494/74 |
| 2,578,456 | 12/1951 | Smith | 494/27 |
| 4,286,748 | 9/1981 | Bailey | 494/29 |
| 4,299,352 | 11/1981 | Erickson | 494/27 |
| 4,406,651 | 9/1983 | Dudrey et al. | 494/29 |
| 4,959,158 | 9/1990 | Meikrantz . | |
| 5,571,070 | 11/1996 | Meikrantz et al. . | |
| 5,591,340 | 1/1997 | Meikrantz et al. . | |

*Primary Examiner*—Charles E. Cooley
*Attorney, Agent, or Firm*—Blakely, Sokoloff Taylor & Zafman LLP

[57] ABSTRACT

A self-cleaning rotor assembly for a centrifugal separator can be thoroughly cleaned of accumulated solids without disassembly of the separator. The rotor assembly comprises a fully welded, enclosed rotor body. The rotor assembly has a double-ended, hollow axial shaft. The bottom end of the axial shaft extends through the separator housing and has a high pressure fluid coupling. A plurality of spray nozzles are fitted to the axial shaft within the rotor body. The spray nozzles are arranged to spray a washing fluid radially onto the interior surfaces of the rotor. The interior volume of the rotor is divided into a plurality of chambers by a corresponding plurality of axial vanes. At least one nozzle is disposed within each of the chambers.

2 Claims, 2 Drawing Sheets

SELF-CLEANING ROTOR FOR A CENTRIFUGAL SEPARATOR

BACKGROUND OF THE INVENTION

1. Field of the Invention

This invention relates generally to centrifugal separators for separating mixed liquids of different densities, and more particularly to a self-cleaning rotor assembly for such separators.

2. Prior Art

Centrifugal devices are widely used for separating materials of different densities. Such devices have been found to provide a highly satisfactory method of separating liquids from one another based on different weight phases.

Separators, also referred to as extractors, can separate the individual components of a mixed component input stream, provided that the components remain in separate phases. In many instances, extraction may be facilitated with the use of a solvent that is injected into the device as a second input stream. In this case, the device is often referred to as a "contactor" since it brings the process stream and the solvent stream into intimate contact. The solvent phase, together with the soluble specie(s), is then separated from the carrier phase by differentiation of the phase densities. Typically, the process liquids comprise a lighter (less dense) solvent or organic phase and a heavier aqueous phase, which are introduced into the centrifugal contactor through separate inlets that communicate with a mixing zone. The resulting liquid mixture then enters the rotor of the contactor where centrifugal force separates the heavier phase from the lighter phase by forcing the heavier phase to flow outwardly away from the rotational axis of the rotor and thereby displace the lighter phase closer to the rotational axis of the rotor. The two phases are then individually collected at the upper end of the rotor with the heavier phase exiting at a location adjacent to the outer periphery and the lighter phase exiting at a location adjacent to the rotational axis. Typically, one or both of the exiting phases is subjected to one or more subsequent stages of extraction such as by circulation through another contactor.

A method of centrifugally separating the components of a water-petroleum mixture is described in U.S. Pat. No. 4,959,158 issued to the second-named inventor of this application. The method described therein utilized a centrifugal contactor developed by the U.S. Department of Energy for the extraction of transuranic elements from radioactive waste streams at nuclear processing plants. It was discovered that this device could be advantageously employed for the separation of a water-petroleum mixture. Improvements to the basic contactor design are disclosed in U.S. Pat. No. 5,591,340 and U.S. Pat. No. 5,571,070, both of which are commonly assigned with the present application.

The centrifugal separator disclosed in U.S. Pat. No. 5,591,340 employs a welded rotor assembly. During normal use, particularly when separating water/petroleum mixtures, solids suspended within the mixture tend to accumulate in the interior of the rotor assembly. Such solids are difficult to remove from a welded, enclosed rotor assembly. Backflushing of the rotor has not produced satisfactory results. Better results have been obtained by disassembling the separator and removing the rotor assembly. However, this is a time-consuming operation, thereby causing the separator to be removed from service for an extended period of time.

SUMMARY OF THE INVENTION

The present invention comprises a self-cleaning or "clean-in-place" rotor assembly that can be thoroughly cleaned of accumulated solids without disassembly of the separator. The rotor assembly comprises a fully welded, enclosed rotor body. The rotor assembly has a double-ended, hollow axial shaft. The bottom end of the axial shaft extends through the separator housing and has a high pressure fluid coupling. A plurality of spray nozzles are fitted to the axial shaft within the rotor body. The spray nozzles are arranged to cover virtually all of the interior surfaces of the rotor.

In order to clean the rotor assembly, the separation process is interrupted and the process fluids are drained from the rotor and housing. A cleaning solution is then admitted under high pressure through the fluid coupling at the bottom end of the axial shaft to wash the interior surfaces of the rotor assembly. The cleaning solution and materials removed from the rotor walls drain through the normal inlet of the rotor assembly and the bottom drain of the separator housing.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

Figure 1:
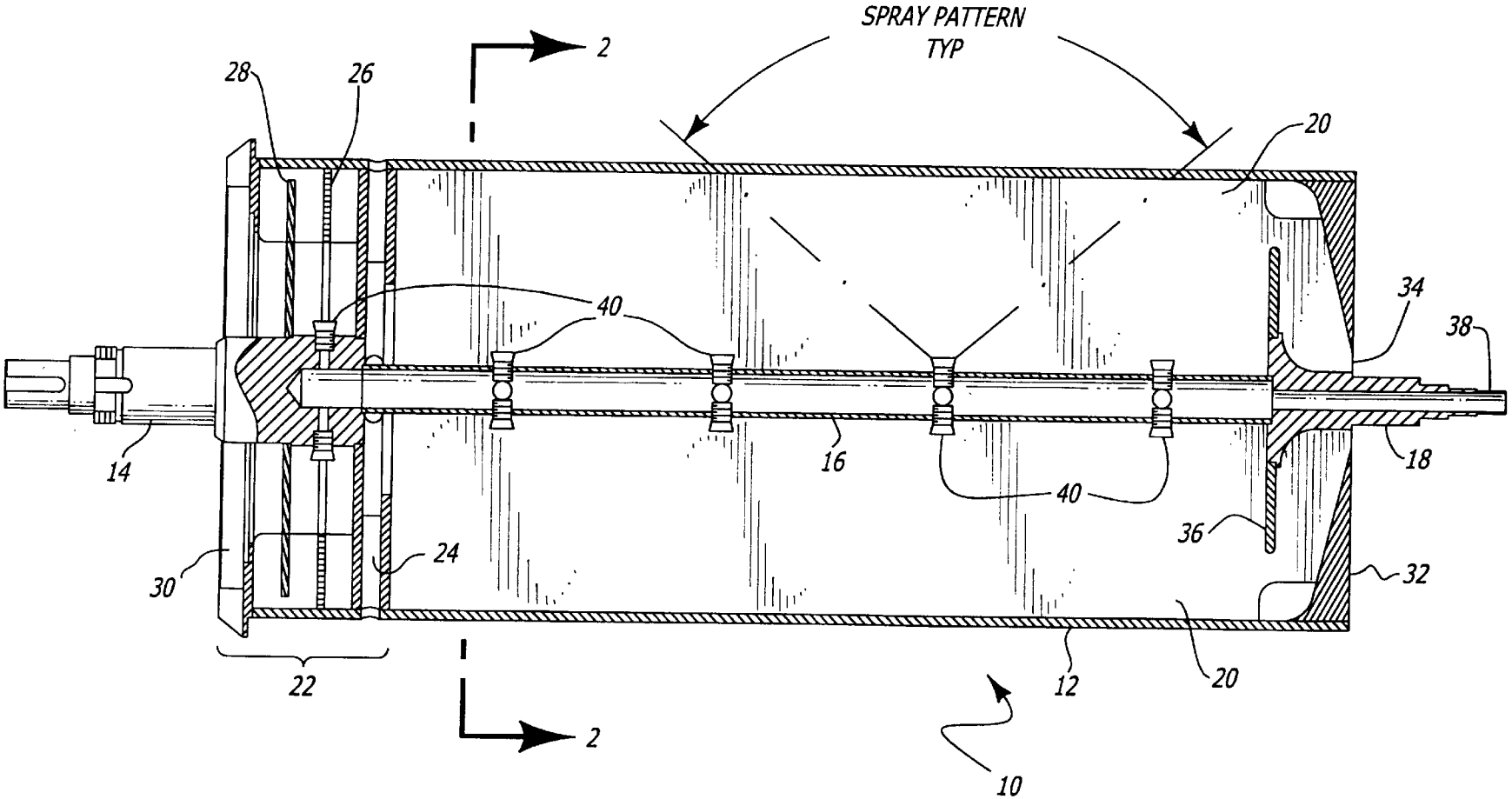
FIG. 1 is a cross-sectional view of a rotor assembly constructed in accordance with the present invention.
Figure 2:
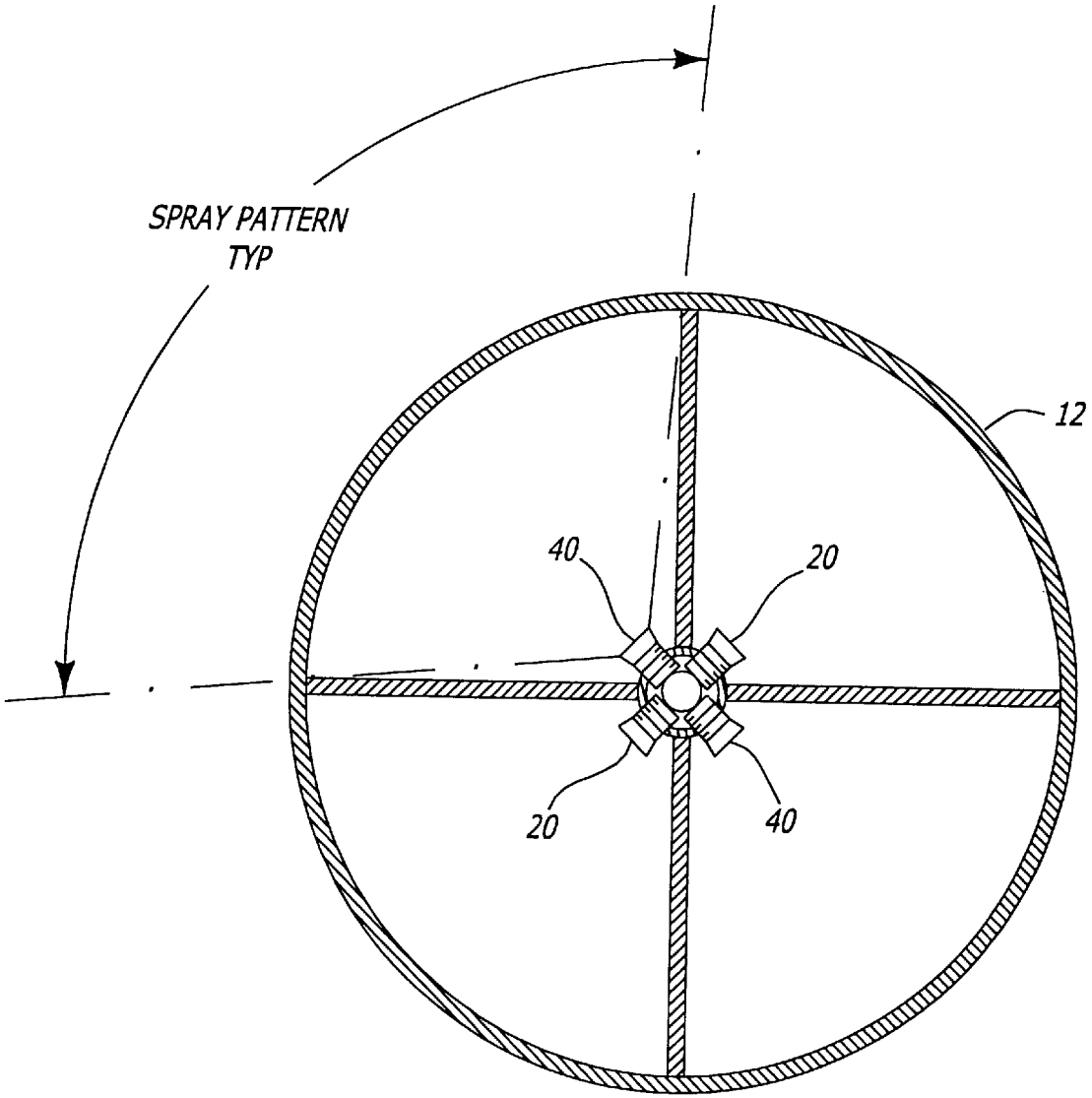
FIG. 2 is a cross-sectional view taken along Line 2—2 of FIG. 1.

As shown in FIGS. 1 and 2 rotor assembly 10 is enclosed by a cylindrical wall 12. The axial rotor shaft comprises upper shaft 14, central shaft 16, and tail shaft 18. The interior volume of rotor assembly 10 is divided by axial vanes 20, which are welded both to the axial shaft of the rotor and to the cylindrical wall 12.

The top assembly 22, where phase separation occurs, comprises organic or lighter phase slinger 24, weir plate 26, baffle plate 28 and aqueous or heavier phase slinger 30. At the bottom of rotor assembly 10, bottom plate 32 as welded to cylindrical wall 12 and to axial vanes 20. A central hole in bottom plate 32 defines annular opening 34 around tail shaft 18. During normal operation of the separator, the liquid mixture to be separated is admitted to the interior of rotor assembly 10 through annular opening 34. Diverter plate 36 is mounted on tail shaft 18 immediately above annular opening 34 to direct the inlet mixture toward cylindrical wall 12.

The lowermost portion 38 of tail shaft 18 extends through the separator housing (not shown) when the separator is fully assembled. Portion 38 is configured as a high-pressure fluid coupling of a quick-disconnect, rotary or other conventional configuration to receive a conduit coupled to a reservoir or other source of cleaning solution (not shown).

A plurality of spray nozzles 40 are inserted radially through central shaft 16 and upper shaft 14. Although not shown, additional spray nozzles may be inserted radially through tail shaft 18 if additional spray coverage is desired below diverter plate 36. Spray nozzles 40 are arranged to give spray coverage of virtually all of the interior surfaces of rotor assembly 10. As best seen in FIG. 2, spray nozzles 40 are installed in groups of four to cover each of the interior chambers defined by axial vanes 20. Suitable spray nozzles are available from Bete Nozzle Company as part number "Full Cone WL-1-½". These nozzles nominally have a conical spray pattern with an included angle of 120°. Other spray patterns may be used depending on the particular geometry of the rotor assembly. Moreover, nozzles having different spray patterns may be used in different portions of the rotor assembly in order to optimize coverage of the internal surfaces.

It is important to note that the interior of rotor assembly 10 can be cleaned without disassembling the separator in which the rotor assembly is installed. Cleaning is accomplished by first suspending the separation process and allowing the process fluids to drain through annular opening 34 and thence through the bottom drain of the separator housing (not shown). A high pressure supply of cleaning solution is then fed to lowermost portion 38 of tail shaft 18. The cleaning solution is forced through spray nozzles 40 to effectively wash the interior surfaces of rotor assembly 10. The cleaning solution and materials removed from the interior surfaces drain out through annular opening 34 and thence through the bottom drain of the separator housing. The particular cleaning solution employed will depend on the nature of the materials accumulating on the interior surfaces of rotor assembly 10. Various solvents and detergents suitable for use are well-known to practitioners in the art. Following injection of the cleaning solution, the interior of the rotor assembly may be rinsed with plain water or other suitable neutralizing agent. The rotor cleaning sequence can be performed manually, semi-automatically or by fully automated means.

It will be recognized that the above described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. A self-cleaning rotor for a centrifugal separator comprising:

a generally cylindrical rotor body having a top portion and a bottom portion, the bottom portion including a bottom aperture for admitting a liquid mixture to be separated into the rotor body;

a hollow axial shaft disposed within the rotor body and coaxial therewith, said shaft supporting the rotor body for rotation;

a fluid coupling at a first end of the shaft; and a plurality of spray nozzles inserted radially through the hollow axial shaft in fluid communication with the fluid coupling, said nozzles oriented to spray a fluid in a radial direction towards an interior wall of the rotor body, wherein the rotor body is configured to collect the sprayed fluid for drainage through the bottom aperture.

2. The self-cleaning rotor of claim 1 wherein the rotor body includes interior baffles defining a plurality of interior chambers and wherein at least one spray nozzle is disposed within each chamber.

* * * * *